US010940063B2

(12) United States Patent
Eason

(10) Patent No.: US 10,940,063 B2
(45) Date of Patent: Mar. 9, 2021

(54) RECIPROCATING DRIVE MOTION WHEELCHAIR

(71) Applicant: Ben Eason, Spring Beach, TX (US)

(72) Inventor: Ben Eason, Spring Beach, TX (US)

( * ) Notice: Subject to any disclaimer, the term of this patent is extended or adjusted under 35 U.S.C. 154(b) by 233 days.

(21) Appl. No.: 16/199,578

(22) Filed: Nov. 26, 2018

(65) Prior Publication Data

US 2019/0216660 A1 Jul. 18, 2019

Related U.S. Application Data

(60) Provisional application No. 62/616,798, filed on Jan. 12, 2018.

(51) Int. Cl.

| | |
|---|---|
| ***A61G 5/02*** | (2006.01) |
| ***A61G 5/10*** | (2006.01) |
| ***A61G 5/12*** | (2006.01) |

(52) U.S. Cl.

CPC ..... *A61G 5/026* (2013.01); *A61G 5/022* (2013.01); *A61G 5/025* (2013.01); *A61G 5/1008* (2013.01); *A61G 5/1018* (2013.01); *A61G 5/1024* (2013.01); *A61G 5/1035* (2013.01); *A61G 5/128* (2016.11); *A61G 5/1054* (2016.11)

(58) Field of Classification Search

CPC ..... A61G 5/026; A61G 5/022; A61G 5/021; A61G 5/025

See application file for complete search history.

(56) References Cited

U.S. PATENT DOCUMENTS

| | | | | | |
|---|---|---|---|---|---|
| 2,643,898 | A * | 6/1953 | Everest | A61G 5/0825 | 280/240 |
| 3,666,292 | A * | 5/1972 | Bartos | A61G 5/025 | 280/234 |
| 4,560,181 | A * | 12/1985 | Herron | A61G 5/023 | 280/244 |
| 4,762,332 | A * | 8/1988 | Seol | A61G 5/023 | 192/28 |
| 4,993,732 | A * | 2/1991 | Wedemeyer | A61G 5/022 | 280/250.1 |
| 5,263,729 | A * | 11/1993 | Watwood | A61G 5/022 | 280/246 |
| 5,499,833 | A | 3/1996 | Her et al. | | |
| 5,941,547 | A * | 8/1999 | Drake | A61G 5/025 | 280/242.1 |
| 6,158,757 | A * | 12/2000 | Tidcomb | A61G 5/023 | 280/244 |
| 6,820,885 | B1 * | 11/2004 | Oshimo | A61G 5/025 | 280/243 |
| 6,893,035 | B2 * | 5/2005 | Watwood | A61G 5/023 | 280/242.1 |
| 6,910,701 | B1 | 6/2005 | Long et al. | | |

(Continued)

*Primary Examiner* — Ruth Ilan
*Assistant Examiner* — Michael R Stabley
(74) *Attorney, Agent, or Firm* — Boudwin Intellectual Property

(57) ABSTRACT

A reciprocating drive motion wheelchair is provided. The wheelchair device includes a low-profile wheelchair that utilizes push bars pivotally connected to the wheelchair frame and operably connected to a crank bar, which run parallel to the ground and connects back to a crank on each wheel. An additional pair of wheels is disposed rearward of the drive wheels and prevents the wheelchair from tipping, thus allowing the user to utilize the push bars to move the wheelchair quickly and easily.

10 Claims, 3 Drawing Sheets

(56) References Cited

U.S. PATENT DOCUMENTS

| | | | | |
|---|---|---|---|---|
| 7,520,519 | B2 * | 4/2009 | Smurthwaite, Jr. .... | A61G 5/023 280/242.1 |
| 7,677,586 | B2 * | 3/2010 | Bloom ..... | A61G 5/023 280/250.1 |
| 7,837,210 | B2 * | 11/2010 | Kylstra ..... | A61G 5/023 280/250.1 |
| 8,152,188 | B2 | 4/2012 | Kylstra | |
| 9,144,525 | B2 | 9/2015 | Richter | |
| 2008/0073869 | A1 * | 3/2008 | Patterson ..... | A61G 5/1035 280/244 |

* cited by examiner

RECIPROCATING DRIVE MOTION WHEELCHAIR

CROSS REFERENCE TO RELATED APPLICATIONS

This application claims the benefit of U.S. Provisional Application No. 62/616,798 filed on Jan. 12, 2018. The above identified patent application is herein incorporated by reference in its entirety to provide continuity of disclosure.

BACKGROUND OF THE INVENTION

The present invention relates to wheelchairs and similar devices. More specifically, the present invention relates to reciprocating drive motion wheelchairs wherein crank bars pivotally attached to the wheels and the frame.

Many individuals with limited or zero leg mobility utilize a wheelchair for transportation. Most wheelchairs include an annular grip disposed along the circumference of the larger rear wheels. Users move the wheelchair by grasping the grips and spinning each of the wheels, which is not only impractical and somewhat ineffective, but also leads to injuries to the deltoid muscles and other small muscle groups in the arms and chest. It can also cause premature exhaustion, while larger, high endurance muscle groups remain unused. Additionally, people can develop blisters on their hands over time from gripping wheelchair wheels. In order to address these concerns, the present invention provides a reciprocating drive wheelchair that can be easily maneuvered utilizing a pair of push bars disposed on either side of the wheelchair.

Devices have been disclosed in the known art that relate to wheelchairs operated by hand cranks and similar mechanisms. These include devices that have been patented and published in patent application publications. One of these devices relates to a wheelchair and drive mechanism powered by reciprocating operation of a drive lever. Another device relates to a wheelchair propulsion system with a continuous input drive path of linear or elliptical shape. These devices in the known art, however, fail to disclose a reciprocating drive wheelchair configured to change direction via motion of a single drive handle.

In light of the devices disclosed in the known art, it is submitted that the present invention substantially diverges in design elements from the known art and consequently it is clear that there is a need in the art for an improvement to existing manually operated wheelchair mechanisms. In this regard, the instant invention substantially fulfills these needs.

SUMMARY OF THE INVENTION

In view of the foregoing disadvantages inherent in the known types of manually operated wheelchairs now present in the known art, the present invention provides a reciprocating drive motion wheelchair wherein the same can be utilized for providing convenience for the user when manually propelling a wheelchair using the occupants own power while utilizing larger muscle groups in a familiar push-pull motion.

It is therefore an object of the present invention to provide a new and improved manually operated wheelchair device that has all of the advantages of the known art and none of the disadvantages. The present system comprises a chair frame having a seat and backrest portion with extending armrests and hingedly attached footrests with a first pair of larger wheels disposed on the frame towards the connection of the seating portion with the backrest portion while a second, smaller pair of wheels is rotatably attached to the frame near the hingedly connected footrests wherein a pair of drive bars are rotatably connected to a pair of crank shafts that are operated by a user in order to spin the first pair of wheels and propel the wheelchair forward.

It is another object of the present invention to provide a reciprocating drive motion wheelchair wherein the crank shafts are rotatably connected to the first pair of wheels via a concentric metal bar attached to the frame of the wheel wherein the pivotal connection between the crankshafts and the concentric metal bars and the pivotal connection between the crank shafts and the drive bars are comprised of ball and socket joints while the rotatable connection of the drive bars with the chair frame is comprised of roller bearing joints.

Another object of the present invention is to provide a reciprocating drive motion wheelchair wherein a braking mechanism comprising a disk braking assembly is operably attached to the first pair of wheels and the drive bars such that hand brakes located on the drive bars may independently apply pressure to each wheel in order to decelerate that wheel to change directions or come to a stop.

Yet another object of the present invention is to provide a reciprocating drive motion wheelchair wherein a third pair of wheels extends behind the first pair of wheels from the rear of the chair frame behind the backrest portion such that the first pair of wheels is between the second and third pairs to provide stability for the reciprocating drive motion wheelchair device.

Another object of the present invention is to provide a reciprocating drive motion wheelchair wherein each drive bar and be independently operated to change direction or come to a stop or can be used in unison to propel the wheelchair forward or backward depending on the direction of the first movement of the drive bars.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
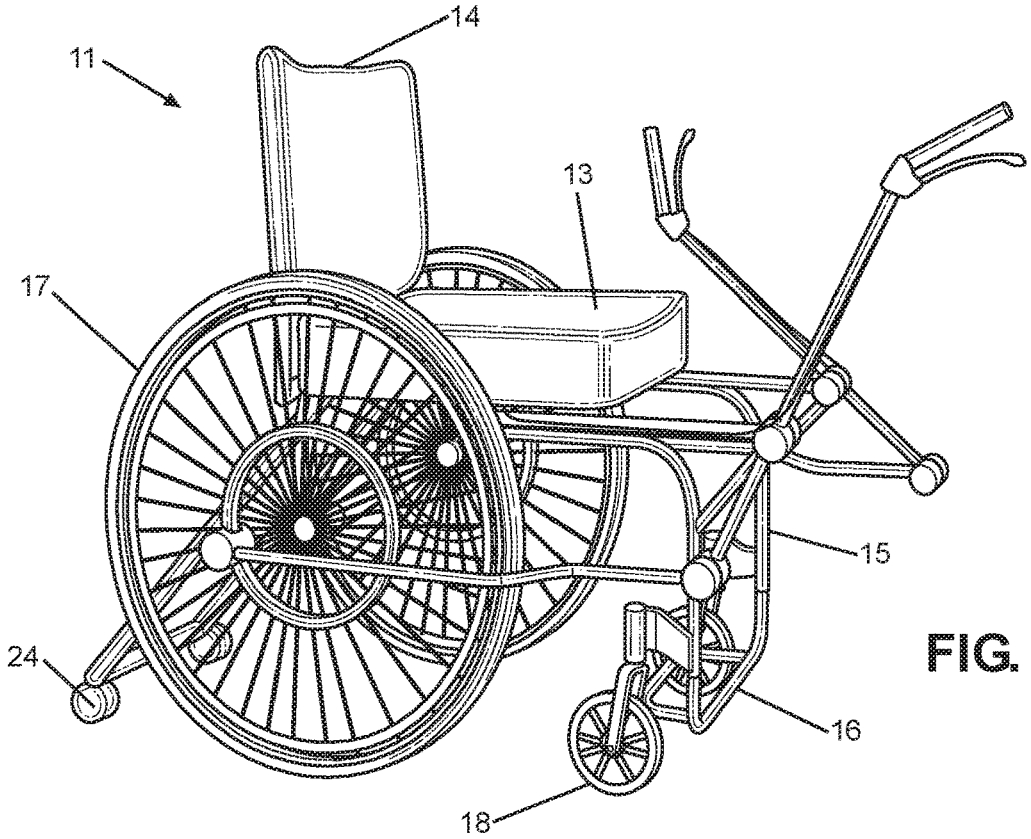
FIG. 1 shows a perspective view of an embodiment of the reciprocating drive motion wheelchair.

Reference is made herein to the attached drawings. Like reference numerals are used throughout the drawings to depict like or similar elements of the Reciprocating drive motion wheelchair. For the purposes of presenting a brief and clear description of the present invention, the preferred embodiment will be discussed as used for manually propelling a wheelchair via drive bars controlling a reciprocating drive motion. The figures are intended for representative purposes only and should not be considered to be limiting in any respect.

Figure 2:
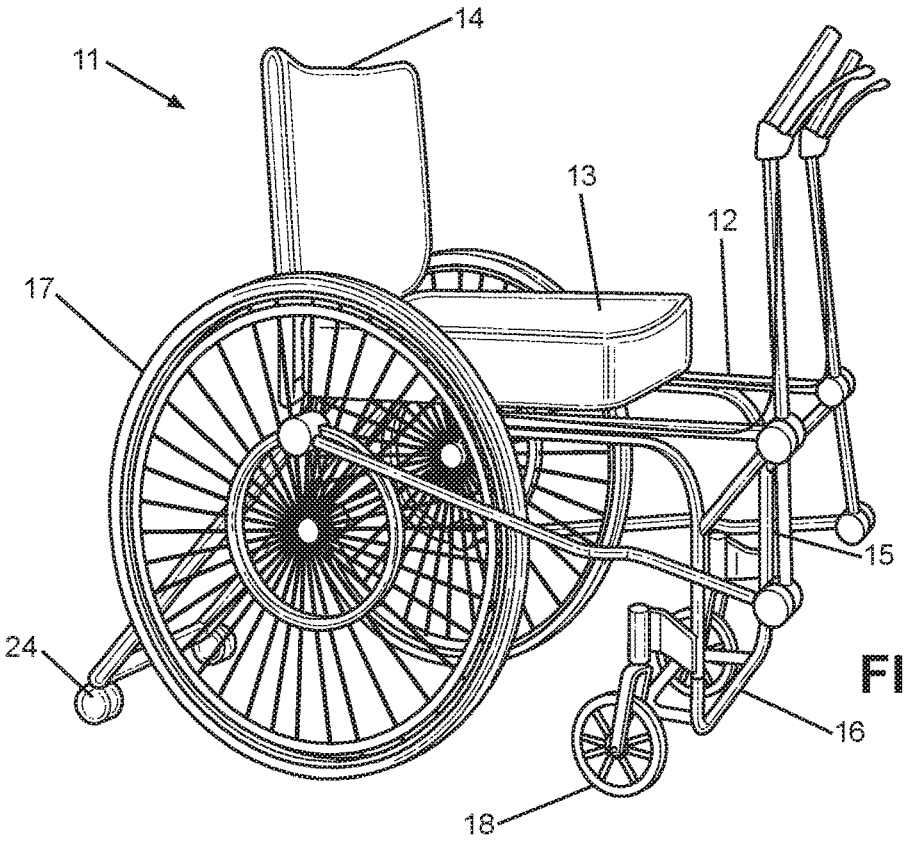
FIG. 2 shows a perspective view of an embodiment of the reciprocating drive motion wheelchair.

Referring now to FIGS. 1 and 2, there are shown multiple perspective views of an embodiment of the reciprocating drive motion wheelchair. The reciprocating drive motion wheelchair 11 comprises a chair frame 12 having a seating portion 13 and a backrest portion 14. A pair of armrests extend orthogonally from each side of the backrest portion 14 of the chair frame 12 in a parallel orientation with the seating portion 13. Legs 15 extend down from an end of the seating portion 13 opposite of the connection with the backrest portion 14 wherein a footrest 16 is hingedly attached to each leg 15. The footrests 16 may be folded up to allow for a user to more easily climb into and out of the reciprocating drive motion wheelchair 11 while the footrests 16 may be folded down at a right angle with the leg 15 of the chair frame 12 to allow for a user to place their feet thereon.

A first pair of wheels 17 is disposed on a rear portion of the chair frame 12 and mounted on either side of the connection between the seating portion 13 and the backrest portion 14. A second pair of wheels 18 having a smaller diameter than the first pair of wheels 17 is rotatably mounted to the bottom of the leg portion 15 of the chair frame 12. This allows the reciprocating drive motion wheelchair 11 to be supported on the two pairs of wheels 17 and 18 with the chair frame 12 in an upright position such that a user may sit within. The second pair of wheels 18 can rotate in a 360-degree fashion on the end of the leg portion 15 of the chair frame 12 to allow the reciprocating drive motion wheelchair 11 to move in varying directions. In one embodiment of the reciprocating drive motion wheelchair 11, a third pair 24 of wheels extends outwardly from the back of the chair frame 12 for stability such that the first pair of wheels is in between the second and third pairs of wheels 18 and 24.

Figure 3:
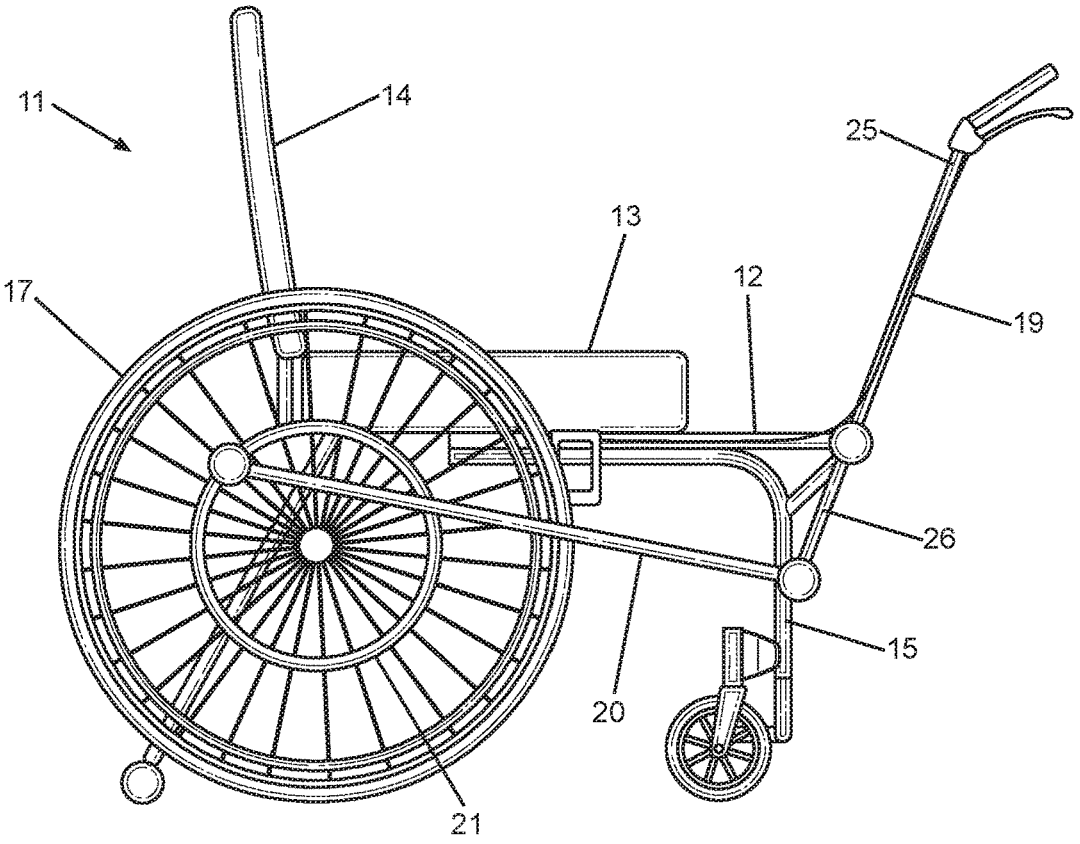
FIG. 3 shows a side view of an embodiment of the reciprocating drive motion wheelchair showing the drive mechanism.

Referring now to FIG. 3, there is shown a side view of an embodiment of the reciprocating drive motion wheelchair showing the drive motion. A pair of drive bars 19 are disposed on either side of the seating portion 13 opposite of the connection between the seating portion 13 and the backrest portion 14 of the chair frame 12. The drive bars 19 comprise elongated rods which are rotatably connected to the chair frame 12 in a forward position relative to the point at which the leg portion 15 connects to the seating portion 13. The drive bars 19 have a first end 25 and a second end 26 and are rotatably connected to the chair frame 12 at a point between these two ends via a roller bearing joint. The first end 25 of the drive bars 19 extends upward from the chair frame 12 and are adapted to be gripped in a user's hands. The second end 26 of the drive bars 19 extends downward from the rotatable roller bearing joint and terminate in a pivotal connection with a crank shaft 20. Each crank shaft 20 is in turn pivotally connected to each of the first pair of wheels 17. The crank shafts 20 are pivotally connected to each wheel via a concentric bar 21 extending outward from the frame of each of the first pair of wheels 17. In the illustrated embodiment, the pivotal connection between the second end of the drive bar 19 and the crank shaft 20 and between the crank shaft 20 and the concentric bar 21 are comprised of ball and socket joints. Each drive bar 19 is independently attached to a crank shaft 20 which in turn is independently attached to each wheel of the first pair of wheels 17. This allows for a user to operate both wheels in unison or independently of each other through the operation of one or both of the drive bars 19. In this manner, a user may control the speed and direction of the wheelchair's movement and turning. The forward or backward motion of each wheel may be determined by the direction of the initial push or pull on the drive bar 19 connected to each wheel of the first pair of wheels 17.

Figure 4:
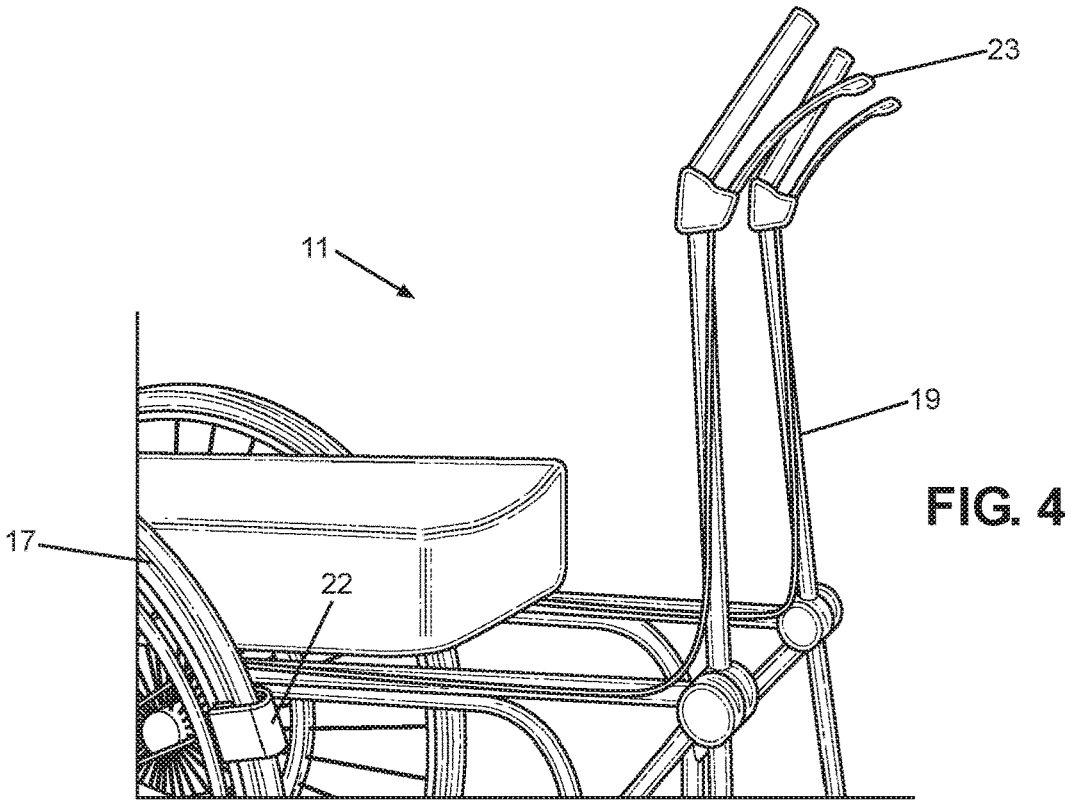
FIG. 4 shows a close-up perspective view of the drive bars of an embodiment of the reciprocating drive motion wheelchair.

Referring now to FIG. 4, there is shown a close-up perspective view of the drive bars of an embodiment of the reciprocating drive motion wheelchair. In some embodiments, a braking mechanism 22 is included on the reciprocating drive motion wheelchair 11. The braking mechanism 22 consists of a disk braking mechanism which is coupled with each wheel of the first pair of wheels 17. The disk braking mechanism is operably connected to hand brakes 23 located on the first end of the drive bars 19. The hand brakes 23 comprise pull triggers which, when actuated, exert pressure from the braking mechanism 22 against the wheel via a brake pad. The frictional engagement of the brake pad against the wheel causes deceleration of the wheel. Each hand brake can be selectively used independently of the other which allows a user to decelerate one or both wheels in order to change direction or come to a complete stop.

Figure 5:
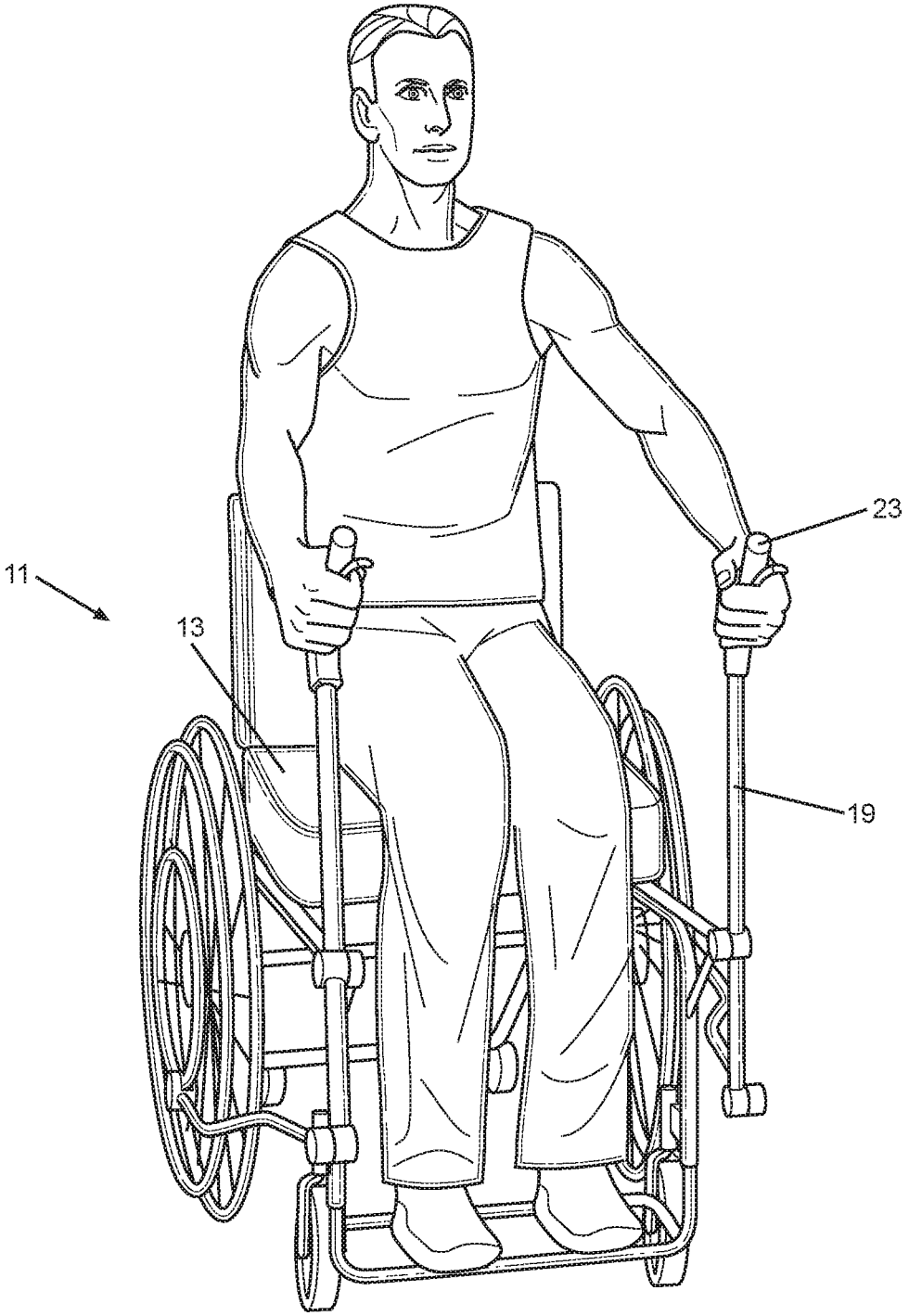
FIG. 5 shows a perspective view of an embodiment of the reciprocating drive motion wheelchair in use.

Referring now to FIG. 5, there is shown a perspective view of an embodiment of the reciprocating drive motion wheelchair in use. A user positioned in the seating position 13 will control the reciprocating drive motion wheelchair 11 by gripping each of the drive bars 19 positioned on the outside of either leg with one hand. In the illustrated embodiment, the drive bars 19 are of a height such as to allow the first end of the drive bar 19 be approximately level with a user's torso. This positioning of the drive bars 19 allows for the larger muscle groups of the upper body to be utilized instead of the smaller muscle groups that are utilized in operation of a conventional wheelchair. The larger muscle groups utilized by the drive bars 19 being in a position of a traditional push/pull motion do not fatigue and get overworked as quickly as the smaller groups used to rotate the wheels manually in regular wheelchairs.

The drive system of the present invention allows for many variations of the movement of the reciprocating drive motion wheelchair 11. Alternating or simultaneous pushing and pulling of each drive bar causes forward or rearward motion of the wheelchair, depending upon the direction of the initial push, allowing complete control of motion and providing improved mobility compared to traditional wheelchairs. While the chair is in motion, the hand brakes 23 on each drive bar 19 can be lightly applied independently to allow for course adjustments and turning. While stationary, either one of the hand brakes 23 may be actuated while leaving the opposite open and operating the drive bar 19 will allow the reciprocating drive motion wheelchair 11 to pivot about that wheel and turn around or change directions. In this way, the direction of the wheelchair may be controlled solely via independent application of the brakes.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reciprocating drive motion wheelchair, comprising:

a chair frame having a seating portion, a backrest portion, and two hingedly connected footrests wherein the seating area and backrest area intersect orthogonally while the footrests hingedly attach to a leg portion of the chair frame extending from an end of the seating portion opposite the backrest portion;

a first pair of wheels mounted to a rear portion of the chair frame, wherein each wheel of the first pair of wheels comprises a frame;

wherein a linear distance between a rear edge of the seat portion and the first pair of wheels is less than a linear distance between a front edge of the seat portion and the first pair of wheels;

a second pair of wheels having a smaller diameter than the first pair of wheels and rotatably mounted to a forward portion of the chair frame at a point near the hingedly connected footrests wherein the second pair of wheels may freely rotate in a 360-degree fashion relative to the ground surface;

a pair of drive bars rotatably attached on each side of the chair frame and operably connected to a pair of crank shafts which in turn are operably connected to the first pair of wheels, wherein each drive handle and crank shaft are independently connected to a wheel of the first pair of wheels to allow for operation in unison or independently of each other;

wherein the crank shafts are rotatably connected to a concentric metal bar attached to the frame of each wheel of the first pair of wheels mounted to the chair frame.

2. The reciprocating drive motion wheelchair of claim 1, wherein the pivotal connections between the drive bars and crank shaft and between the crank shaft and concentric metal bar comprises ball and socket joints.

3. The reciprocating drive motion wheelchair of claim 1, wherein the pivotal connection between the drive bars and the chair frame comprise roller bearing joints.

4. The reciprocating drive motion wheelchair of claim 1, wherein a third pair of wheels extends outward from the rear portion of the chair frame, such that the first pair of wheels rest between the second and third pairs of wheels.

5. The reciprocating drive motion wheelchair of claim 1, wherein a braking mechanism is operably attached to the first pair of wheels.

6. The reciprocating drive motion wheelchair of claim 5, wherein the braking mechanism comprises a disk braking assembly wherein a brake pad is selectively applied to the frame of the first pair of wheels to cause deceleration.

7. The reciprocating drive motion wheelchair of claim 5, wherein hand brakes are pivotally connected to the pair of drive handles actuate and selectively control the braking mechanism of the first pair of wheels.

8. The reciprocating drive motion wheelchair of claim 7, wherein the hand brakes may be operated independently of each other to apply deceleration to a single wheel to allow for a change of direction or to turn around completely.

9. The reciprocating drive motion wheelchair of claim 1, wherein the first and second pairs of wheels comprise tires having rubber tread circumferences secured around metal frames.

10. The reciprocating drive motion wheelchair of claim 1, wherein the length of the drive bars are selectively adjustable telescopically.

* * * * *